United States Patent [19]

Perisic

[11] Patent Number: 4,794,973

[45] Date of Patent: Jan. 3, 1989

[54] DOOR SAFETY BAR

[75] Inventor: Milan Perisic, Holden Hill, Australia

[73] Assignee: Automatic Roller Doors Australia Pty. Ltd., Holden Hill, Australia

[21] Appl. No.: 87,229

[22] PCT Filed: Nov. 5, 1986

[86] PCT No.: PCT/AU86/00338

§ 371 Date: Jul. 2, 1987

§ 102(e) Date: Jul. 2, 1987

[87] PCT Pub. No.: WO87/03035

PCT Pub. Date: May 21, 1987

[30] Foreign Application Priority Data

Nov. 6, 1985 [AU] Australia ..... PH3276

[51] Int. Cl.[4] ..... E06B 9/208

[52] U.S. Cl. ..... 160/291; 160/8; 160/201

[58] Field of Search ..... 160/291, 8, 293.1, 298, 160/201; 49/26, 27, 28; 16/DIG. 20, 82

[56] References Cited

U.S. PATENT DOCUMENTS 1,946,920 2/1934 Stahl .
2,661,799 12/1953 Wolf ..... 16/DIG. 20

FOREIGN PATENT DOCUMENTS 73062 1/1982 Australia .
10799 4/1983 Australia .
2042030 2/1971 France .

*Primary Examiner*—Ramon S. Britts
*Assistant Examiner*—Blair M. Johnson
*Attorney, Agent, or Firm*—Henry Sternberg; Bert J. Lewen

[57] ABSTRACT

A safety braking device for a roll up or sliding door having a door curtain guided for movement by guide channels engaging its edges, the safety braking device comprising a tilt bar hingedly attached to the leading edge of the door curtain, and brake means carried on the tilt bar and arranged, upon appreciable tilting movement of the tilt bar, to frictionally engage with the door curtain guide channels for braking the movement of the door.

11 Claims, 2 Drawing Sheets

DOOR SAFETY BAR

Figure 1:
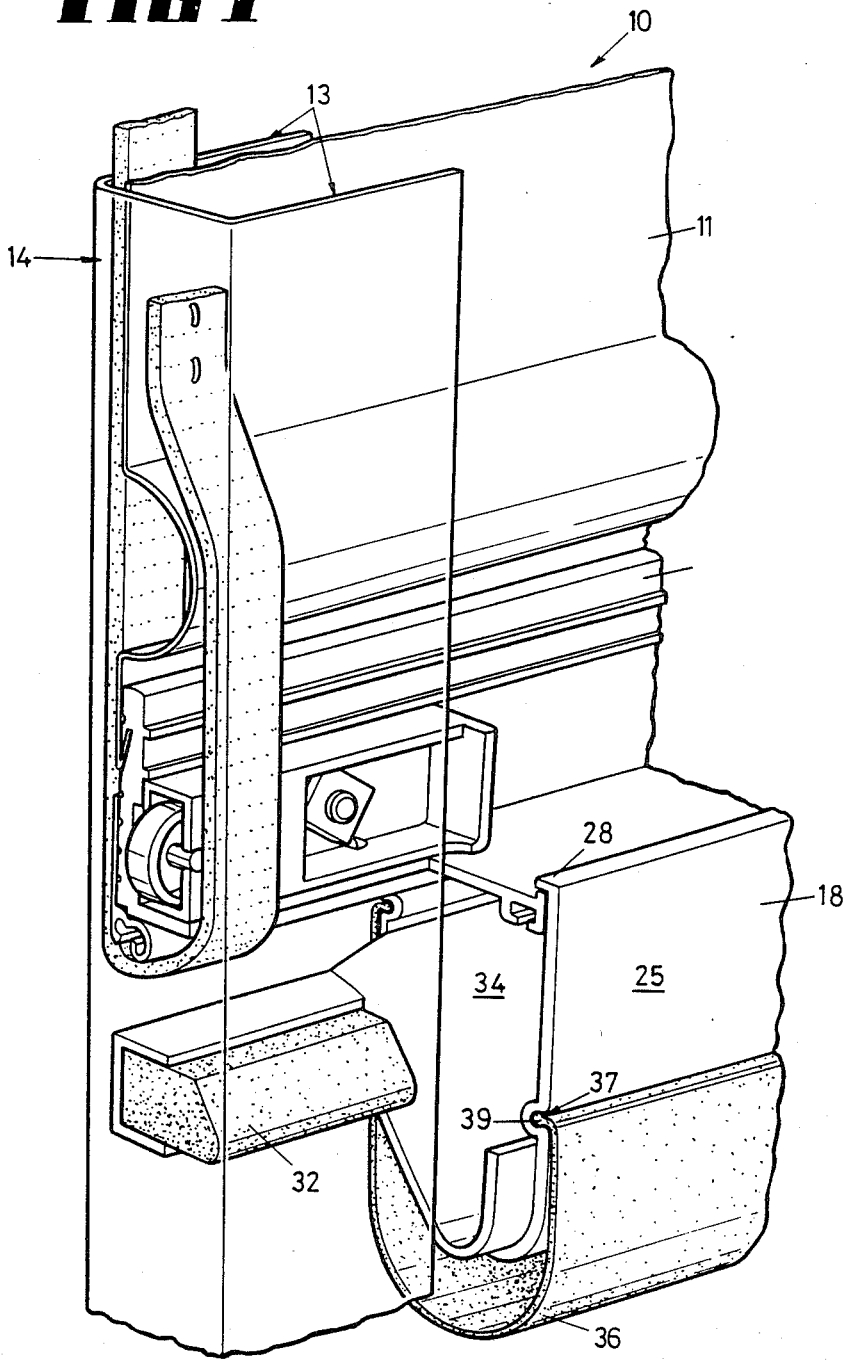

This invention relates to a safety bar for use on a door of the roll-up or sliding type.

The Applicant is aware of a number of different forms of safety reversal means used for reversing the motor of a motor actuated door of the roll-up or sliding type should such door encounter an obstruction, for example a child or animal, and reference is made to U.S. Pat. Nos. 3,891,909, 4,501,963; UK Patent No. 1,604,266; International Patent No. WO 85/01773; and Australian Patent Specification No. 532,820. In some instances, upon the door lowering onto an obstruction, the motor is arranged to send current or voltage and actuate a reversing relay in response to changes in current or voltage to thereby reverse the motor. Reversal means of this type is generally acceptable and can provide a door which functions satisfactorily from the point of view of safety, but notwithstanding this, there is always a danger of maladjustment or malfunction of such sensing means, and the main object of this invention is to provide safety improvements whereby a closing door, in the event of it encountering an obstruction or obstacle in the door opening, will brake almost instantly and will impart only a relatively small amount of force against the object.

It is a further object of the present invention to provide safety reversal means incorporating a safety bar for use on a door of the roll-up type which is effective not only to instantly brake the door upon the door encountering an obstruction, but also to quickly reverse the drive motor of the motor actuated door.

According to this invention therefore, a safety braking device for use in a door of the roller or sliding type comprises a door curtain or panel which is guided for movement along guide channels engaging its edges, said safety braking device comprising mounting means hingedly connected to the leading end of said door curtain or panel for tilting movement about a horizontal axis parallel to the plane of the door curtain or panel, and resistance means carried on said mounting means, and arranged, upon appreciable tilting movement of said mounting means, to coact with said door curtain guide channels for braking the movement of the door, the arrangement being such that when the door encounters an obstruction in its path during closing thereof, said mounting means will tilt about its said hinge axis which in turn results in the door movement being braked by virtue of the interengagement of said resistance means and the door curtain guide channels.

In a preferred embodiment of the invention, the safety braking device comprises an elongate safety bar or rail carried on the leading end of the door so as to be approximately co-extensive therewith, hinge means hingedly connecting said safety bar to said door leading end whereby the safety bar is able to tilt about a horizontal hinge axis, said safety bar carrying brake means engageable, upon appreciable tilting movement of the safety bar, against inner surfaces of the door curtain guide channels to thereby brake the movement of the door, the arrangement being such that upon the door encountering an obstruction, the safety bar is tilted about its hinge axis and the door movement is braked by virtue of the braking force applied by the brake means against the guide channels.

Preferably, the brake means comprises a pair of brake pads, one adjacent each end of said safety bar, each said brake pad being located in close proximity to said hinge axis, the lower or bottom surface of said safety bar being displaced relatively far away from said axis so that there is a mechanical advantage such as will reduce the amount of force imparted against the obstruction, and in any case add a separate braking force to the force offered by the obstruction itself.

In another preferred embodiment of this invention, the safety bar comprises an elongate metal extrusion which is approximately 'V' shaped in cross-section and comprises a first leg portion sloping downwardly away from the hinge axis, an upwardly extending second leg portion having its upper free end contiguous with the inner margin of a bottom rail secured to the bottom edge of said door curtain, and a curved bridge portion interconnecting said leg portions. Preferably the first leg portion comprises a planar cam surface which extends approximately obliquely.

In the specification and appended claims, the term "leading" is used with reference to the direction of movement of the door during closing thereof.

Figure 2A:
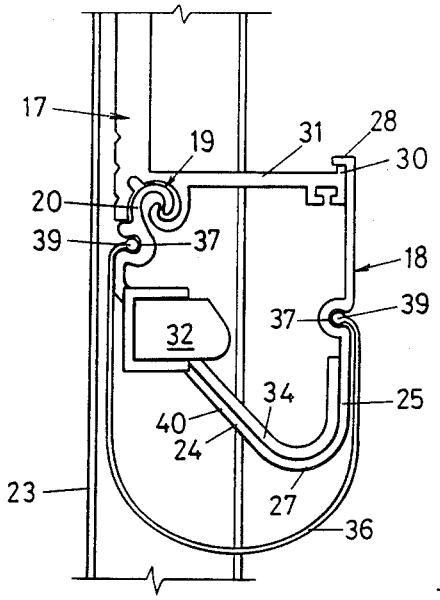
Figure 2B:
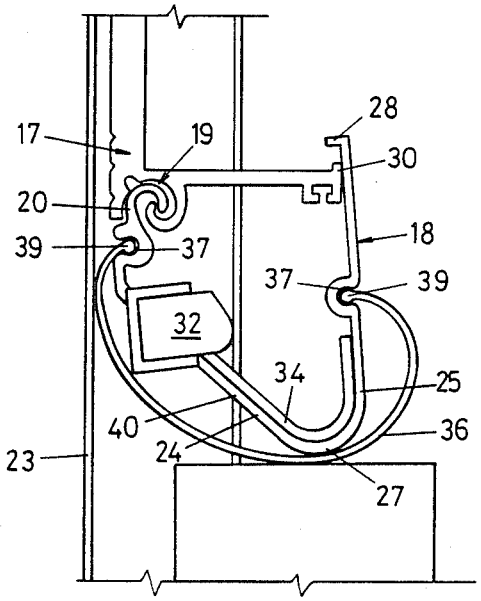

In order to more fully explain the present invention, an embodiment is described hereunder in some further detail with reference to the accompanying drawings in which:

FIG. 1 is a perspective view of a roller door which has fitted thereto a safety braking device according to this invention, FIG. 2(*a*) is an end elevational view showing the braking device in its "out-of-use" position during normal operation of the door, and FIG. 2(*b*) is a view similar to FIG. 2(*a*) showing the braking device in the "braked" position with the curtain guide channel.

In this embodiment, a lift-up roller door 10 is of the type wellknown, comprising a curtain 11 of corrugated sheet metal which winds around a rotatable drum (not shown) disposed horizontally at the top of a door opening 12, the drum being actuated by an electric motor supplied with current through a transformer. The motor drive circuit is provided with automatic reversing means comprising a reversing overload circuit which operates upon sensing of increased motor current or reduced voltage when an obstruction is encountered by the lower end of the door during its closing movement. Such reversing means is well known in the art and thus forms no part of the present invention.

The vertical marginal edges of the door curtain 11 are guided for vertical up and down movement between the flanges 13 of a pair of facing guide channels 14, one at each side of the door opening 12. The lower end of the door curtain 11 is provided, in accordance with known art, with a bottom rail 17 of angle section, the bottom rail 17 serving to stiffen the lower end of the flexible door curtain 11.

An elongate safety tilt bar 18 is hingedly connected by hinge connection 19 to the underside of the bottom rail 17, the hinge connection 19 being formed by interengaging roll formations formed on the underside of the bottom rail 17 and the upper edge 20 of the tilt bar 18. The bar 18 is thus able to undergo limited tilting movement about a horizontal axis which is substantially parallel to the bottom edge of the door curtain 11. In this embodiment, the hinge connection 19 is located adjacent the front margin of the bottom rail 17 (when viewed from outside of the door opening 12), so that the hinge axis is in proximity to the front flange 23 of each of the guide channels 14. In this embodiment the hinged safety tilt bar 18 is formed from aluminium by an extrusion process and is approximately 'V' shaped in cross-section defined by a first leg portion 24 which slopes downwardly and inwardly away from the hinge axis, a second leg portion 25 which extends approximately vertically upwards, and a curved bottom bridge portion 27 which interconnects the leg portions 24, 25. The upper end of the second leg portion 25 terminates in an inturned flange 28 which, when the safety bar 18 is in its normal undisplaced position, locates over and is contiguous with the inner edge 30 of the horizontal leg 31 of the bottom rail 17.

At each end of the elongate safety bar 18 is provided a brake pad member 32 which in this embodiment, is mounted in a sleeve carried on the end of a projecting arm 34 which is slidably located in the end of the bar 18 and held fast therewith. The brake pad members 32 are arranged so that upon any appreciable tilting movement of the safety bar 18, as would for example occur in the event of the door 10 encountering an obstacle during its closing, they frictionally engage against respective inner surfaces of the rear flanges 33 of the guide channels 14 to thereby cause the downward movement of the door curtain 11 to be braked. Preferably, the arrangment is such that as the tilt angle of the bar 18 increases so does the frictional braking force applied by the brake pads 32.

The safety bar 18 has depending from it a 'U' shaped flexible resilient cover strip or member 36 which is provided with enlarged beads or ribs 37 which extend along its upper free edges, the beads or ribs 37 are anchored by respectively engaging in complementary grooves or recesses 39 formed in outer faces of the leg portion 24, 25 of the safety bar 18.

The functioning of the safety bar 18 is as follows:

As the door curtain 11 lowers to close the door 10, any obstruction located in the door opening strikes the resilient 'U' shaped cover member 36 which deforms, the in turn resulting in the bar 18 being tilted about its horizontal hinge axis, such tilting movement causing the brake pad members 32 to frictionally engage against the rear flanges 33 of the guide channels 14 to thereby brake the door descent. The braking of the door causes an increase in motor current (as is well known) and consequential decrease in motor voltage from the motor which is sensed in accordance with known art sensing means comprising a reversing overload circuit, to effect reversal of a reversing relay to cause the motor to run and thus the door movement in a reverse direction, whereupon the safety bar 18 is lifted away from the obstruction and resumes its "normal" non-braking position. In the unlikely event that the motor does not reverse, preferably the arrangement is such that the brake pads 32 impart sufficient frictional force against the door guide channels 14 to arrest downward movement of the safety bar 18 and support the curtain weight as the curtain 11 continues to unwind from its support drum. Only a small portion of this weight needs to be supported by the obstruction which is encountered by the safety bar. Of course, the force applied against an obstruction is reduced due to the resilient nature of the resilient cover strip 36 which depends from and straddles the safety bar 18.

In this embodiment, the first leg portion 24 of the safety bar 18 comprises a downwardly inclined planar surface 40 which constitutes a cam surface designed to afford a mechanical advantage whereby only a very small amount of force is required to effect movement of the safety bar 18 and thereby the actuation of the braking device.

In a variation to the above described embodiment (but not illustrated), the hinge connection between the safety bar and the bottom rail of the door curtain comprises a flexible plastics hinge strip or strap which is provided along its upper and lower edges within enlarged beads or ribs which engage in complementary approximately circular shaped recesses or grooves formed respectively in the underside of the bottom rail and along the upper edge of the first leg portion of the safety bar. Alternatively, the first leg portion of the safety bar may be provided along its upper edge with an enlarged rib or bead which simply snap engages into a complementary recess formed in the underside of the bottom rail of the curtain door. In yet a further variation, there are provided two hinged safety bars hingedly connected to the bottom rail of the door in juxtaposed relationship, each hinged safety bar having a pair of brake pad members one at each end thereof, the arrangement being such that the pair of brake pad members at each end of the bottom rail respectively frictionally engage against the opposed flanges of the corresponding door guide channel.

In a further variation, the brake members are directly affixed to the tilt bar rather than carried on support arms projecting from the ends thereof.

Whilst the above embodiments have been described with respect to a door of the roller type it should be appreciated that the invention can be applied to virtually any type of lift-up door in addition to doors which open and close in a vertical plane by traversing a horizontal track.

The claims defining the invention are as follows:

1. In a door of the roller or sliding type comprising a door curtain or panel having a leading edge which is guided for movement along guide channels engaging its lateral edges, a safety braking device comprising:

mounting means hingedly connected to the leading edge of said door curtain or panel for tilting movement about an axis parallel to the plane of the door curtain or panel, and resistance means carried on said mounting means, and arranged, upon appreciable tilting movement of said mounting means, to engage said guide channels for braking the movement of the door, the arrangement being such that when the leading edge of the door encounters an obstruction in its path during closing thereof, said mounting means will tilt about its said hinge axis which in turn results in the door movement being braked by virtue of the interengagement of said resistance means and the guide channels.

2. A safety braking device according to claim 1 wherein said mounting means comprises an elongate tiltable safety bar which extends along the leading edge of said door curtain.

3. A safety braking device according to claim 2 wherein said elongate safety bar comprises a metal extrusion which is approximately 'V' shaped in cross-section.

4. A safety braking device according to claim 2 or claim 1 wherein said resistance means comprises brake means at each side of said door curtain arranged to engage, upon said appreciable tilting movement of said safety bar, against the inner surfaces of respective said guide channels.

5. A safety braking device according to claim 4 wherein said brake means comprises a pair of brake pads, one adjacent each end of said safety bar, each pad being carried on an arm projecting from an end of said bar.

6. A safety braking device according to claim 5 wherein each said brake pad is located in close proximity to said hinge axis of the tiltable safety bar, the leading or front surface of said safety bar being displaced relatively far away from said hinge axis whereby a mechanical advantage is achieved such as will reduce the amount of force imparted by the door against an obstruction.

7. A safety braking device according to claim 2 wherein said door curtain is provided with a bottom rail secured to and extending along a leading edge of said door curtain, and also wherein said safety bar is approximately 'V' shaped in cross-section comprising a first leg portion sloping downwardly away from its said hinge axis, an upwardly extending second leg portion having its upper free end contiguous with the inner margin of said bottom rail, and a curved bridge portion interconnecting said leg portions.

8. A safety braking device according to claim 7 wherein said first leg portion comprises a planar cam surface which extends approximately obliquely.

9. A safety braking device according to claim 1 or claim 2 further comprising a 'U' shaped deformable resilient cover strip which depends from and straddles said safety bar and is coextensive therewith.

10. A safety braking device according to claim 9 wherein said cover strip has its free marginal edges hingedly connected to respective leg portions of the safety bar.

11. In a roller door assembly of the type comprising a door curtain having a lower edge and guided for vertical movement along guide channels engaging its lateral edges, a safety braking device comprising:

an elongate safety bar carried on the lower edge of said door curtain and approximately coextensive connecting, hinge means hingedly connected said safety bar to said door lower edge whereby the safety bar is able to undergo limited tilting movement about a horizontal axis, brake pads carried on said safety bar at its ends being arranged to frictionally engage, upon appreciable tilting movement of the safety bar, against inner surfaces of the guide channels to thereby brake the movement of the door, the arrangement being such that upon the door leading edge encountering an obstruction, the safety bar is tilted about its hinge axis and the door movement is braked by virtue of the force applied by the brake pads against the guide channels.

* * * * *